US010094227B2

(12) United States Patent
Ding

(10) Patent No.: US 10,094,227 B2
(45) Date of Patent: Oct. 9, 2018

(54) GAS TURBINE ENGINE BLADE TIP TREATMENT

(71) Applicant: UNITED TECHNOLOGIES CORPORATION, Farmington, CT (US)

(72) Inventor: Zhongfen Ding, South Windsor, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 633 days.

(21) Appl. No.: 14/803,497

(22) Filed: Jul. 20, 2015

(65) Prior Publication Data

US 2016/0032738 A1 Feb. 4, 2016

Related U.S. Application Data

(60) Provisional application No. 62/032,856, filed on Aug. 4, 2014.

(51) Int. Cl.
*F01D 5/28* (2006.01)
*C25D 13/24* (2006.01)
(Continued)

(52) U.S. Cl.
CPC ..... *F01D 5/288* (2013.01); *C23C 28/00* (2013.01); *C23C 28/04* (2013.01); *C25D 11/04* (2013.01); *C25D 11/26* (2013.01); *C25D 13/02* (2013.01); *C25D 13/24* (2013.01); *C25D 11/022* (2013.01); *F05D 2220/32* (2013.01); *F05D 2220/36* (2013.01); *F05D 2230/90* (2013.01); *F05D 2300/2112* (2013.01);
(Continued)

(58) Field of Classification Search
CPC . F01D 5/014; F01D 5/018; F01D 5/28; F01D 5/284; F01D 5/286; F01D 5/288; F05D 2230/90; F05D 2260/95; F05D 2300/229; F05D 2300/2291; Y10S 977/40; Y10S 977/776
See application file for complete search history.

(56) References Cited

U.S. PATENT DOCUMENTS 6,159,618 A * 12/2000 Danroc ..... C23C 28/02 428/472
7,285,312 B2 * 10/2007 Li ..... C23C 16/403 427/249.15
(Continued)

OTHER PUBLICATIONS

Bal Seal Engineering. "Hard Anodizing of Aluminum Alloys and Its Effect on BAL™ SEAL Performance." TR-17 (48-7-3)(Rev. C; Mar. 22, 2001), 14 pages.
(Continued)

*Primary Examiner* — Woody Lee, Jr.
*Assistant Examiner* — Topaz L Elliott
(74) *Attorney, Agent, or Firm* — Cantor Colburn LLP

(57) ABSTRACT

A fan blade and method of manufacturing a fan blade includes a metallic fan blade body with a crystalline oxidation layer and immersing the crystalline oxidation layer in a solution of ceramic nanosheets in suspension. A fan blade for a gas turbine engine includes a metallic fan blade body having a tip with a crystalline oxidation layer, wherein the crystalline oxidation layer includes pores containing ceramic nanosheets.

20 Claims, 5 Drawing Sheets

(51) Int. Cl.

| | |
|---|---|
| ***C25D 13/02*** | (2006.01) |
| ***C25D 11/26*** | (2006.01) |
| ***C23C 28/00*** | (2006.01) |
| ***C25D 11/04*** | (2006.01) |
| ***C25D 11/02*** | (2006.01) |
| ***C23C 28/04*** | (2006.01) |

(52) U.S. Cl.
CPC .. *F05D 2300/605* (2013.01); *F05D 2300/611* (2013.01); *Y10S 977/776* (2013.01)

(56) References Cited

U.S. PATENT DOCUMENTS

| | | | | |
|---|---|---|---|---|
| 7,942,638 | B2 * | 5/2011 | Eichmann | F01D 5/28 415/173.1 |
| 8,470,458 | B1 * | 6/2013 | Persky | C23C 28/04 416/241 B |
| 8,668,447 | B2 * | 3/2014 | Sayano | C23C 24/00 415/200 |
| 2007/0099027 | A1 * | 5/2007 | Krishnamurthy | B32B 15/01 428/698 |
| 2013/0004309 | A1 * | 1/2013 | Sambasivan | C04B 35/195 415/208.1 |
| 2013/0149163 | A1 | 6/2013 | Parkos, Jr. | |
| 2013/0333392 | A1 | 12/2013 | Bintz | |
| 2014/0010663 | A1 * | 1/2014 | Parkos, Jr. | F01D 5/147 416/241 R |
| 2014/0272310 | A1 * | 9/2014 | Lazur | B05D 3/002 428/164 |
| 2015/0140331 | A1 * | 5/2015 | Salguero | C01B 35/04 428/402 |
| 2015/0290771 | A1 * | 10/2015 | Li | B24D 3/06 51/295 |

OTHER PUBLICATIONS

Curran, et al., "Porosity in plasma electrolytic oxide coatings," Acta Materialia 54 (2006) 1985-1993, 9 pages.
Military Specification, Anodic Coatings for Aluminum and Aluminum Alloys, MIL-A-8625F, Sep. 10, 1993, 20 pages.
Zeng, et al., "Single-Layer Semiconducting Nanosheets: High-Yield Preparation and Device Fabrication," Nanomaterials, Angewandte Chemie 2011, 123, 11289-11293, 5 pages.

* cited by examiner

GAS TURBINE ENGINE BLADE TIP TREATMENT

CROSS REFERENCE TO RELATED APPLICATION

This application claims the benefit of and incorporates by reference herein the disclosure of U.S. Ser. No. 62/032,856, filed Aug. 4, 2015.

TECHNICAL FIELD OF THE DISCLOSURE

The present disclosure relates generally to a gas turbine engine, and more specifically to a blade tip treatment for a gas turbine engine.

BACKGROUND OF THE DISCLOSURE

Many turbine engines have fans formed by a plurality of blades. One example fan blade includes an aluminum substrate or fan blade body. A polyurethane coating is applied over the fan blade body. In order to obtain better fan performance, an outer air seal is provided in the form of an abradable rub strip. During operation of the gas turbine engine, a tip of the fan blade may rub against the adjacent outer air seal rub strip. During the rub event, the tip may wear and heat may be generated. To this end, the tip of the fan blade body has been anodized to create a hard coating layer.

Heat is generated when the blade hard coating rubs against the abradable rub strip. Because of the very low thermal conductivity (~0.1 W/m K) of a typical abradable rub strip material as compared to the hard coating layer conductivity of ~30 W/m K and the aluminum fan body conductivity of ~160 W/m K, most of the heat generated during a rub event is conducted into the fan blade. Such conduction can cause the blade temperature near the tip to exceed the capability of the polyurethane, and results in degradation of the bonding of polyurethane to the aluminum blade.

SUMMARY OF THE DISCLOSURE

In one embodiment, a method of manufacturing a fan blade is disclosed comprising: immersing at least a crystalline oxidation layer of a metallic fan blade body in a solution of ceramic nanosheets in suspension, the ceramic nanosheets having a charge of a first polarity; and applying a potential of a second polarity to the fan blade body while the crystalline oxidation layer is immersed in the solution of ceramic nanosheets in suspension, wherein the second polarity is different than the first polarity.

In a further embodiment of the above, the fan blade body includes a tip, the tip including the crystalline oxidation layer.

In a further embodiment of any of the above, the crystalline oxidation layer includes a plurality of pore channels therein; and said applying a potential electrophoretically drives at least some of the ceramic nanosheets into at least some of the pore channels.

In a further embodiment of any of the above, the crystalline oxidation layer is an aluminum oxide hard coating layer.

In a further embodiment of any of the above, the aluminum oxide hard coating layer is a MIL-A-8625F Type III coating.

In a further embodiment of any of the above, the ceramic nanosheets comprise a ceramic selected from the group consisting of: $MoS_2$, $MoSe_2$, $WS_2$, $MoSi_2$, $WSe_2$, $TiS_2$, $TaS_2$, and $ZrS_2$.

In a further embodiment of any of the above, the first polarity is negative and the second polarity is positive.

In a further embodiment of any of the above, the potential is a DC potential.

In a further embodiment of any of the above, the fan blade body comprises one of a 7000 series and a 2000 series aluminum alloy.

In a further embodiment of any of the above, the ceramic nanosheets are formed by a process comprising the steps of: intercalating lithium cations between layers of a ceramic starting material to produce an intercalated ceramic structure; and exfoliating the intercalated ceramic structure to produce the ceramic nanosheets.

In a further embodiment of any of the above, the method further comprises the step of adhering a sheath to a leading edge of the fan blade body.

In a further embodiment of any of the above, the adhering step includes arranging an adhesive-saturated scrim between the sheath and the leading edge.

In a further embodiment of any of the above, the method further comprises the step of coating the fan blade body with polyurethane to provide a fan blade contour along with the sheath.

In a further embodiment of any of the above, the crystalline oxidation layer is left exposed subsequent to the coating step.

In another embodiment, a fan blade for a gas turbine engine is disclosed comprising: a metallic fan blade body including a tip with a crystalline oxidation layer; wherein the crystalline oxidation layer includes a plurality of pore channels; and wherein at least some of the plurality of pore channels include ceramic nanosheets.

In a further embodiment of the above, the fan blade body includes a tip, the tip including the crystalline oxidation layer.

In a further embodiment of any of the above, the crystalline oxidation layer is an aluminum oxide hard coating layer.

In a further embodiment of any of the above, the aluminum oxide hard coating layer is a MIL-A-8625F Type III coating.

In a further embodiment of any of the above, the ceramic nanosheets comprise a ceramic selected from the group consisting of: $MoS_2$, $MoSe_2$, $WS_2$, $MoSi_2$, $WSe_2$, $TiS_2$, $TaS_2$, and $ZrS_2$.

In a further embodiment of any of the above, the metallic fan blade body comprises one of a 7000 series and a 2000 series aluminum alloy.

Other embodiments are also disclosed.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

For the purposes of promoting an understanding of the principles of the invention, reference will now be made to certain embodiments and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 1:
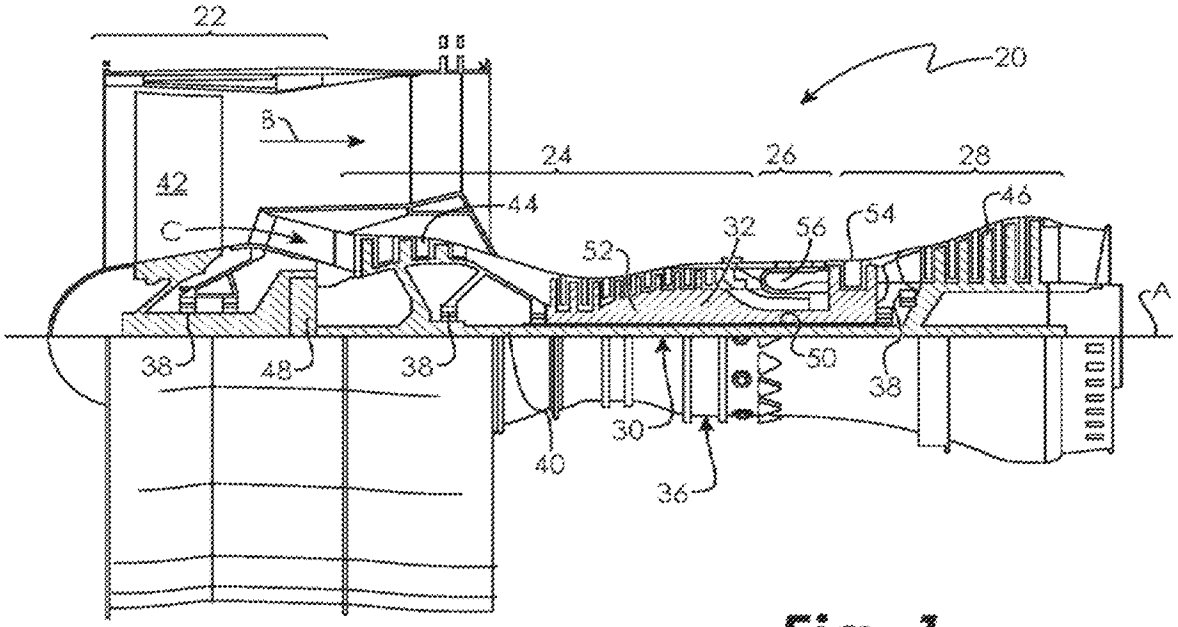
FIG. 1 is a schematic partial cross-sectional view of a gas turbine engine in an embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is the pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram °R})/(518.7°\text{R})]^{0.5}$. The "Low corrected fan tip speed" as disclosed herein according to one non-limiting embodiment is less than about 1150 ft/second (350.5 m/sec).

Figure 2:
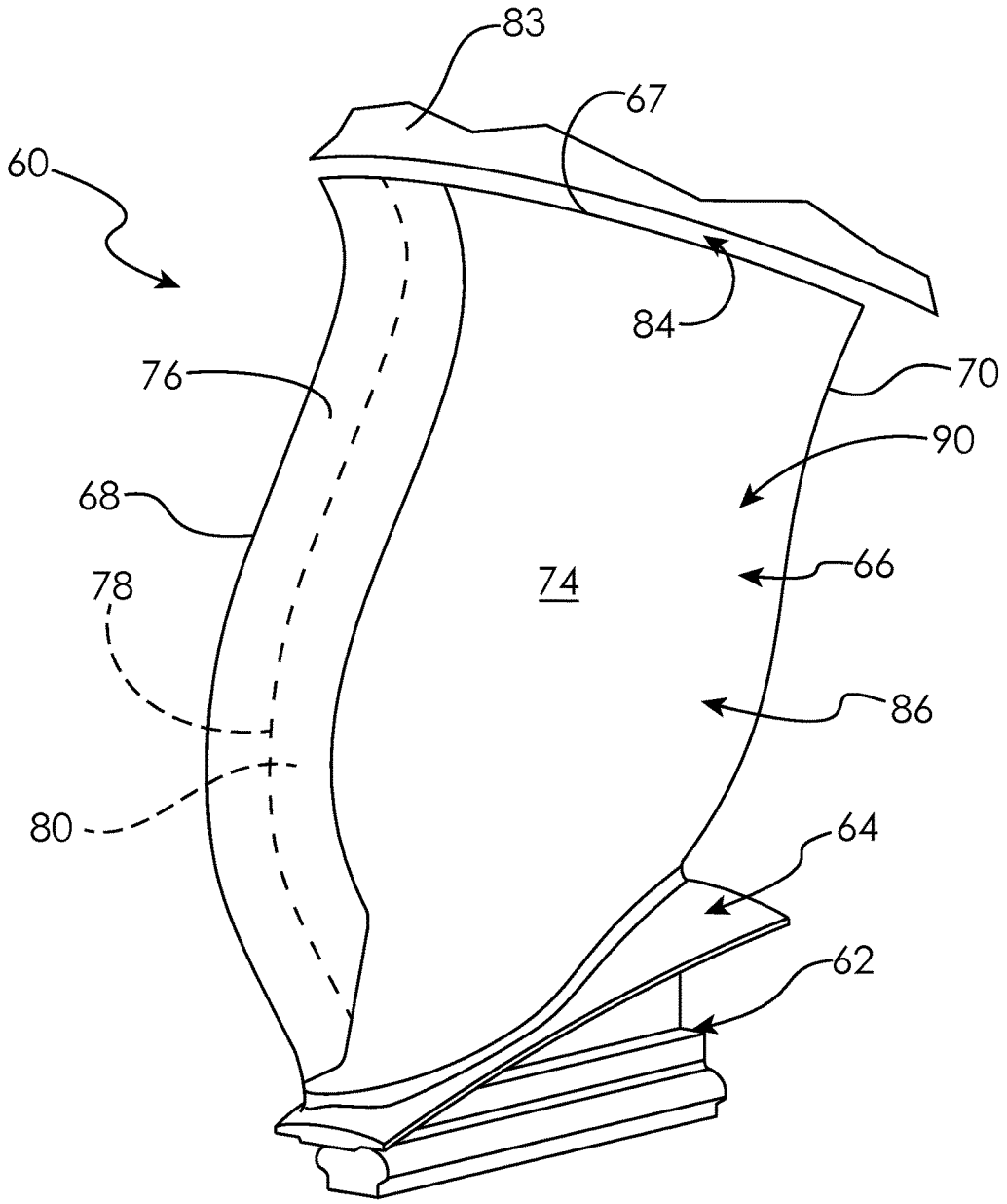
FIG. 2 is a perspective view of an embodiment of a fan blade of the engine shown in FIG. 1.

Referring to FIG. 2, a fan blade 60 of the fan 42 includes a root 62 supporting a platform 64. An airfoil 66 extends from the platform 64 to a tip 67. The airfoil 66 includes spaced apart leading and trailing edges 68, 70. Pressure and suction sides 72 (FIG. 3), 74 adjoin the leading and trailing edges 68, 70 to provide a fan blade contour 86. It should be understood that the fan blade 60 is exemplary, and "platformless" fan blades may also be used.

The tip 67 is arranged adjacent to a sealing structure 83, which is typically arranged in relation to the tip 67 to provide a clearance 84. During certain engine operating conditions, the tip 67 may be prone to rubbing the sealing structure 83, which can generate heat and undesirably wear the tip 67.

Each fan blade 60 includes an aluminum fan blade body 80, which may be hollow or solid. In one example, the fan blade body 80 is constructed from a 7000 series aluminum alloy, such as 7255. In another example, a 2000 series aluminum is used. Other aluminum alloys, other metals, and other materials such as, for example, titanium and titanium alloys, may also be used.

Figure 3:
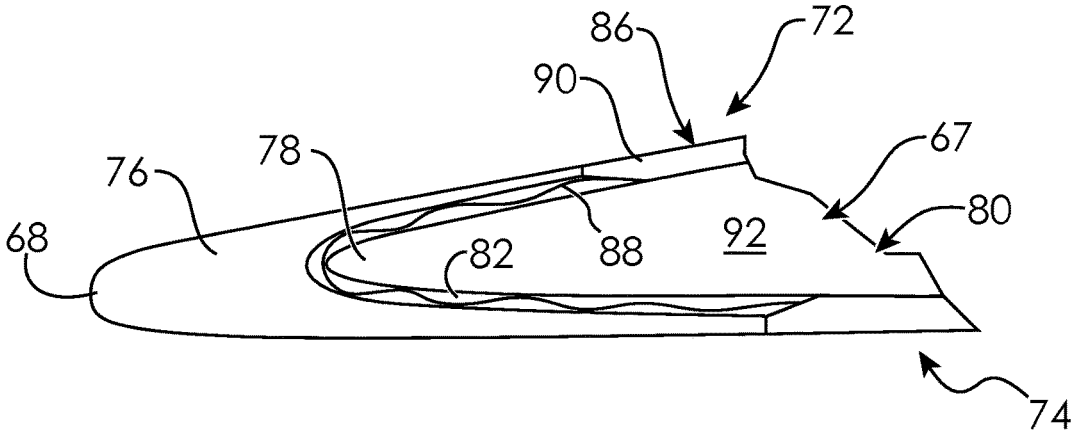
FIG. 3 is an end view of the fan blade shown in FIG. 2, according to an embodiment.

The fan blade body 80 has a leading edge 78. A sheath 76 may be secured to the fan blade body 80 over the edge 78 with adhesive 82. In one example, the sheath 76 and the fan blade body 80 are constructed from first and second metals that are different from one another. In one example, the sheath 76 is constructed from a titanium alloy. It should be understood that other metals or materials may be used. The adhesive 82 provides a barrier between the fan blade body 80 and the sheath 76 to prevent galvanic corrosion. Referring to FIG. 3, the adhesive 82 may include a scrim 88 (e.g., a glass fiber scrim) that carries the adhesive 82 in an embodiment.

A polymer coating 90 may be applied over the fan blade body 80 adjacent to the sheath 76 to provide a fan blade contour 86. The coating 90 is polyurethane in one embodiment, but may be any other polymeric coating. The substrate provided by the fan blade body 80 may be masked to leave at least the tip 67 exposed so that the tip 67 may be oxidized. A chemical masking, mechanical masking tape, lacquer, or other painted on coating may be used and temporarily deposited upon the exterior surface of the fan blade body 80. Since the oxidation process requires significant voltage, reducing the area to be oxidized greatly reduces the necessary power and cost of oxidizing the tip 67.

The tip 67 is oxidized to produce a crystalline aluminum oxide hard coating layer 92, as shown in FIG. 3. For example, the hard coating layer 92 may be a Type III hard anodic coating as described in United States Military Specification MIL-A-8625F.

Figure 4:
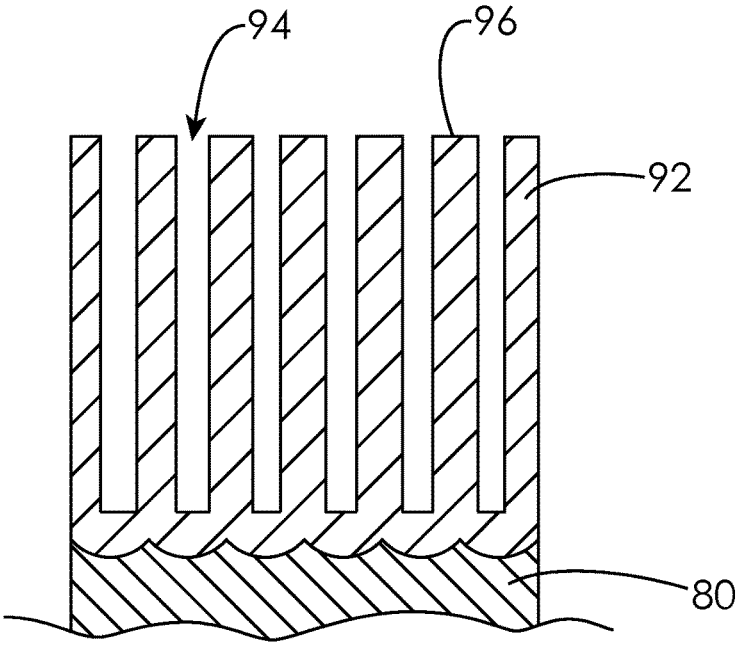
FIG. 4 is a schematic cross-sectional view of a fan blade tip and hard coating layer in an embodiment.

Referring to the schematic representation of FIG. 4, in an embodiment, the hard coating layer 92 has a porous structure with pore channels 94 aligned substantially perpendicular to the hard coating layer 92 surface 96. In order to reduce the thermal conductivity of the hard coating layer 92, ceramic nanosheets may be deposited inside the pore channels 94 of the hard coating layer 92 using, for example, electrophoretic force. The ceramic nanosheets will reduce the thermal conductivity of the hard coating layer 92 without changing the mechanical properties of the hard coating layer 92 since the ceramic nanosheets do not comprise a layer applied to the surface 96 of the hard coating layer 92.

Figure 5:
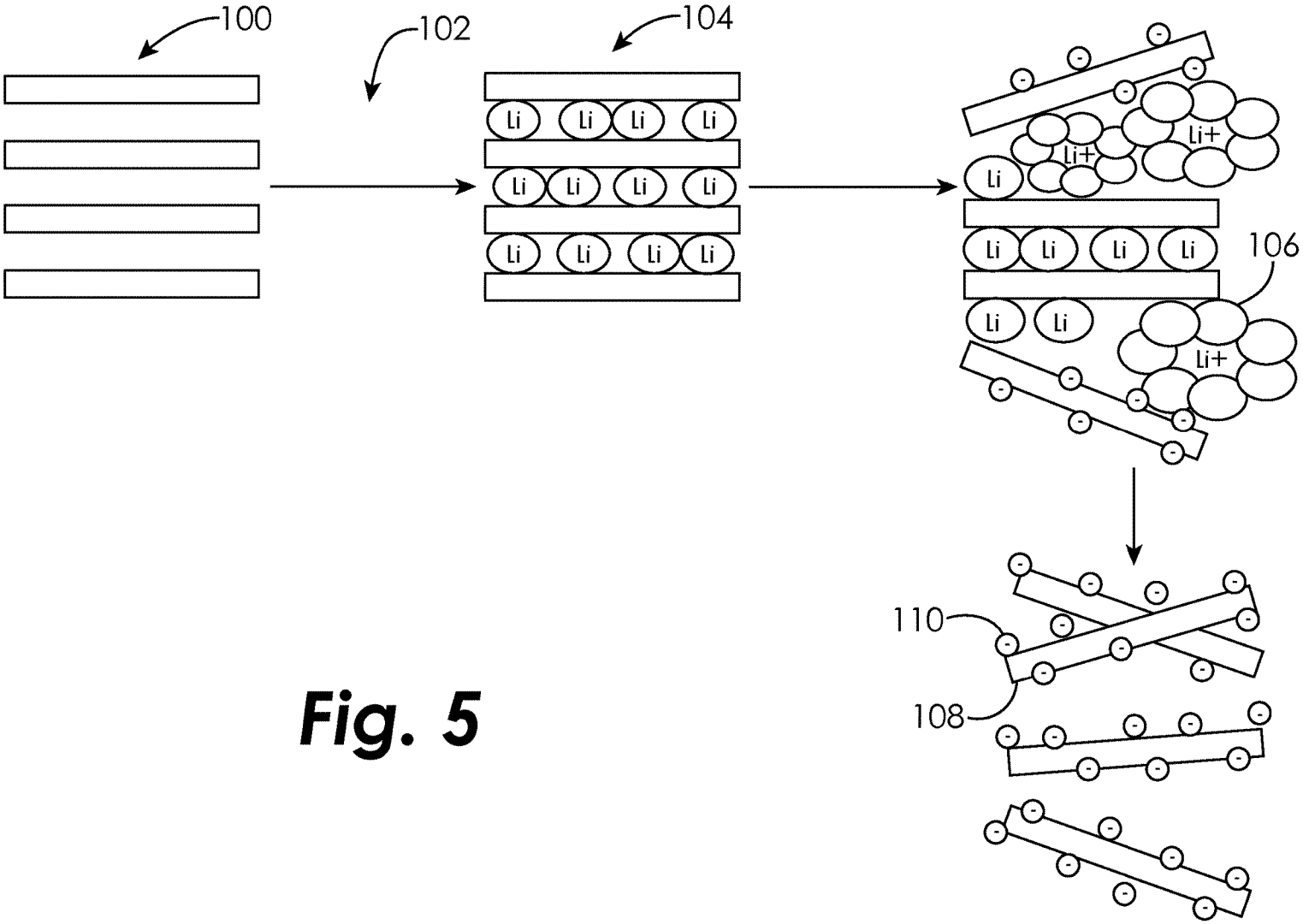
FIG. 5 is a schematic process diagram of a lithium intercalation and exfoliation process in an embodiment.

Referring to FIG. 5, ceramic nanosheets may be generated through an intercalation and exfoliation process, to name just one non-limiting example, which generates a ceramic nanosheet suspension stabilized with a negative electrical charge on the surface. Starting ceramic materials 100, such as $MoS_2$, $MoSe_2$, $WS_2$, $MoSi_2$, $WSe_2$, $TiS_2$, $TaS_2$, and $ZrS_2$, to name just a few non-limiting examples, may be used. A process 102 of lithium intercalation may be used to intercalate lithium cations between the layers of starting ceramic material 100 in a liquid environment, swelling the crystal and weakening the interlayer attraction within the starting ceramic material 100. There are multiple lithium intercalation processes known in the art, including the N-butyl lithium method, the lithium metal dissolved in liquid ammonia method, and the electrochemical lithiation method, which provides high yield single layer ceramic nanosheets, to name just a few non-limiting examples. The present embodiments include the use of any intercalation process. This produces the intercalated ceramic structure 104. The lithium cations may then be removed via an exfoliation process 106 in water, where lithium cations are surrounded by $H_2O$ molecules (shown at 106) and exfoliated from the intercalated ceramic structure 104, producing a suspension of ceramic nanosheets 108 having negative electrical charge 110 on the surface thereof.

Figure 6:
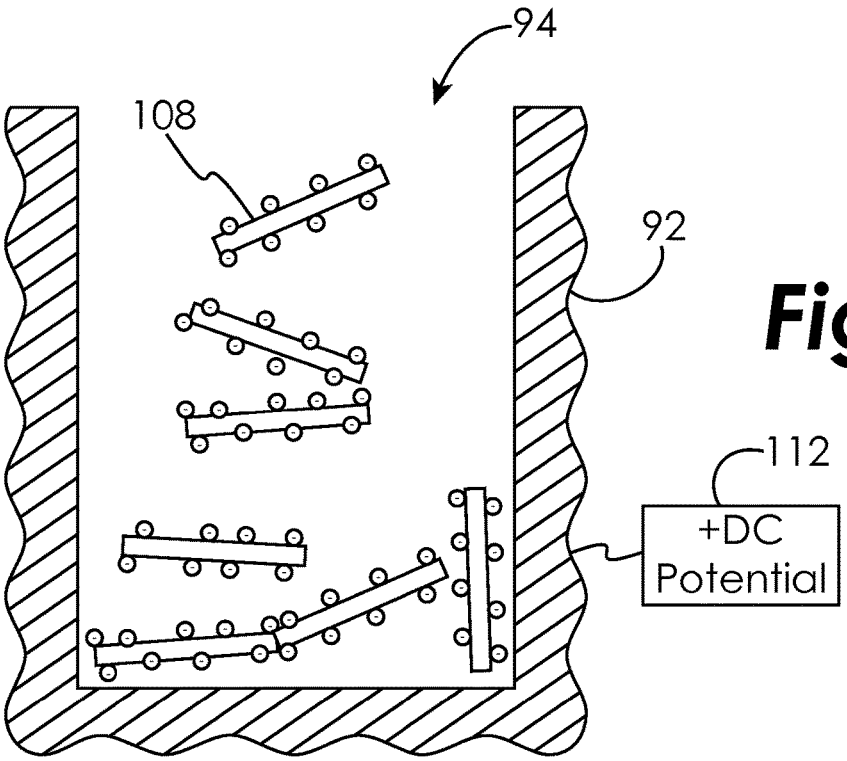
FIG. 6 is a schematic cross-sectional view of a fan blade tip and hard coating layer in an embodiment.
Figure 7:
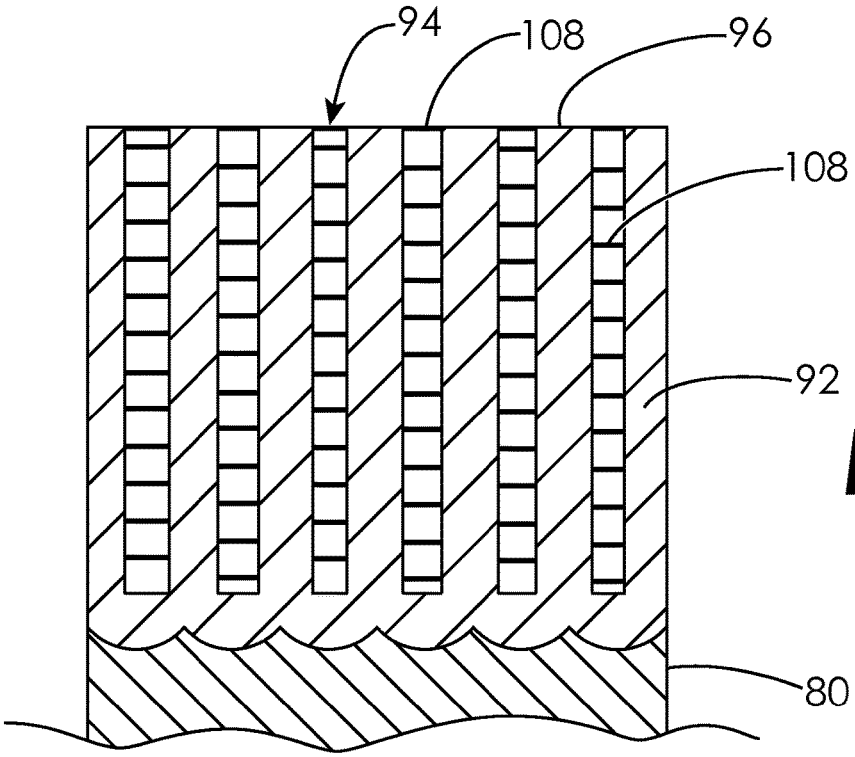
FIG. 7 is a schematic cross-sectional view of a fan blade tip and hard coating layer in an embodiment.

The hard coating layer 92 may then be submerged in the ceramic nanosheet 108 suspension. A positive potential 112, such as a positive DC potential in an embodiment, may be connected to the fan blade body 80 to electrophoretically drive the ceramic nanosheets 108 into the pore channels 94 of the hard coating layer 92, as shown in FIGS. 6 and 7. It will be appreciated from the present disclosure that if the ceramic nanosheets 108 have a positive charge, then a negative charge may be applied to the fan blade body 80. The ceramic nanosheets 108 have an extremely low coefficient of friction and will also serve as a lubricant during rubbing between the tip 67 and the sealing structure 83. With less friction during rub events, less heat will be generated during abrasion. With the ceramic nanosheets 108 filling the hard coating, phonon scattering will increase and thus the thermal conductivity of the hard coating layer 92 will decrease. The addition of the ceramic nanosheets 108 to the hard coating layer 92 does not change the mechanical properties of the hard coating layer 92 with respect to abrasion resistance, and the added lubrication provided by the ceramic nanosheets 108 will reduce the wear of the hard coating layer 92. Both the lower friction and reduced thermal conductivity of the hard coating layer 92 operate to lower the fan blade body 80 temperature rise during rub events and reduce the risk of compromising the polyurethane coating 90 on the fan blade body 80.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed:

1. A method of manufacturing a fan blade comprising:

immersing at least a crystalline oxidation layer of a metallic fan blade body in a solution of ceramic nanosheets in suspension, the ceramic nanosheets having a charge of a first polarity; and applying a potential of a second polarity to the fan blade body while the crystalline oxidation layer is immersed in the solution of ceramic nanosheets in suspension, wherein the second polarity is different than the first polarity.

2. The method according to claim 1, wherein the fan blade body includes a tip, the tip including the crystalline oxidation layer.

3. The method according to claim 1, wherein:

the crystalline oxidation layer includes a plurality of pore channels therein; and said applying a potential electrophoretically drives at least some of the ceramic nanosheets into at least some of the pore channels.

4. The method according to claim 1, wherein the crystalline oxidation layer is an aluminum oxide hard coating layer.

5. The method according to claim 4, wherein the aluminum oxide hard coating layer is a MIL-A-8625F Type III coating.

6. The method according to claim 1, wherein the ceramic nanosheets comprise a ceramic selected from the group consisting of: $MoS_2$, $MoSe_2$, $WS_2$, $MoSi_2$, $WSe_2$, $TiS_2$, $TaS_2$, and $ZrS_2$.

7. The method according to claim 1, wherein the first polarity is negative and the second polarity is positive.

8. The method according to claim 1, wherein the potential is a DC potential.

9. The method according to claim 1, wherein the fan blade body comprises one of a 7000 series and a 2000 series aluminum alloy.

10. The method according to claim 1, wherein the ceramic nanosheets are formed by a process comprising the steps of:

intercalating lithium cations between layers of a ceramic starting material to produce an intercalated ceramic structure; and exfoliating the intercalated ceramic structure to produce the ceramic nanosheets.

11. The method according to claim 1, further comprising the step of adhering a sheath to a leading edge of the fan blade body.

12. The method according to claim 11, wherein the adhering step includes arranging an adhesive-saturated scrim between the sheath and the leading edge.

13. The method according to claim 12, further comprising the step of coating the fan blade body with polyurethane to provide a fan blade contour along with the sheath.

14. The method according to claim 13, wherein the crystalline oxidation layer is left exposed subsequent to the coating step.

15. A fan blade for a gas turbine engine comprising:

a metallic fan blade body including a tip with a crystalline oxidation layer;

wherein the crystalline oxidation layer includes a plurality of pore channels; and wherein at least some of the plurality of pore channels include ceramic nanosheets.

16. The fan blade according to claim 15, wherein the fan blade body includes a tip, the tip including the crystalline oxidation layer.

17. The fan blade according to claim 15, wherein the crystalline oxidation layer is an aluminum oxide hard coating layer.

18. The fan blade according to claim 15, wherein the aluminum oxide hard coating layer is a MIL-A-8625F Type III coating.

19. The fan blade according to claim 15, wherein the ceramic nanosheets comprise a ceramic selected from the group consisting of: $MoS_2$, $MoSe_2$, $WS_2$, $MoSi_2$, $WSe_2$, $TiS_2$, $TaS_2$, and $ZrS_2$.

20. The fan blade according to claim 15, wherein the metallic fan blade body comprises one of a 7000 series and a 2000 series aluminum alloy.

* * * * *